US005654545A

United States Patent [19]

Holle et al.

[11] Patent Number: 5,654,545

[45] Date of Patent: Aug. 5, 1997

[54] MASS RESOLUTION IN TIME-OF-FLIGHT MASS SPECTROMETERS WITH REFLECTORS

[75] Inventors: Armin Holle, Oyten; Claus Köster, Lilienthal; Jochen Franzen, Bremen, all of Germany

[73] Assignee: Bruker-Franzen Analytik GmbH, Bremen, Germany

[21] Appl. No.: 627,370

[22] Filed: Apr. 4, 1996

[30] Foreign Application Priority Data

Sep. 19, 1995 [DE] Germany ..... 195 34 712.9

[51] Int. Cl.[6] ..... H01J 49/40

[52] U.S. Cl. ..... 250/287; 250/282

[58] Field of Search ..... 250/287, 286, 250/282, 281

[56] References Cited

U.S. PATENT DOCUMENTS

| | | | |
|---|---|---|---|
| 3,668,384 | 6/1972 | Moorman et al. | 250/287 |
| 5,032,722 | 7/1991 | Boesl et al. | 250/287 |
| 5,464,485 | 11/1995 | Cornich et al. | 250/287 |
| 5,504,326 | 4/1996 | Reilly et al. | 250/287 |
| 5,510,613 | 4/1996 | Reilly et al. | 250/287 |

FOREIGN PATENT DOCUMENTS

| | | |
|---|---|---|
| 0403965 | 12/1990 | European Pat. Off. . |
| 3842044 | 6/1990 | Germany . |

OTHER PUBLICATIONS

A Duckworth et al., *Analysis of laser–ablated solid samples using a small time of flight mass spectrometer*, Meas. Sci. Technol. vol. 3, pp. 596–602, 1992.

Johann M. Grundwurmer et al., *High–resolution mass spectrometry in a linear time–of–flight mass spectrometer*, International Journal of Mass Spectrometry and Ion Processes, vol. 131, pp. 139–148, 1994.

Hellmut Haberland et al., *Converting a reflection time–of–flight mass spectrometer into a tandem instrument*, Rev. Sci. Instrum. vol. 62, pp. 2368–2371, Oct. 1991.

*Primary Examiner*—Jack I. Berman
*Assistant Examiner*—Kiet T. Nguyen

[57] ABSTRACT

A method for the high resolution analysis of analyte ions in a time-of-flight mass spectrometer. The method consists of the generation of an intermediate time-focus plane for ions of a certain mass at a location between an ion source and an ion reflector, and then using the ion reflector to temporally focus the ions of equal mass and differing velocities which pass this plane at the same time onto a detector. For time-of-flight mass spectrometers with an ion selector, the ion selector is particularly favorable location for this intermediate plane with time focus; and with a collision cell for the collision fragmentation of the ions, the collision cell is a particularly favorable location.

14 Claims, 3 Drawing Sheets

MASS RESOLUTION IN TIME-OF-FLIGHT MASS SPECTROMETERS WITH REFLECTORS

The invention relates to high resolution analysis of ions with reflectron type time-of-flight mass spectrometers, whereby the ions are generated by laser desorption, particularly matrix-assisted laser desorption, from sample substances (analytes) on sample supports. In detail it relates to the process for improving mass resolution by the known method of delayed acceleration (sometimes called "delayed extraction", "time lag focusing", or "pulsed ion extraction") of the ions, and devices for the performance of this method.

The invention consists of the generation of an intermediate time-focus plane for ions of a certain mass at a location between ion source and reflector, and then using the reflector to temporally focus the ions of equal mass and differing velocities which pass this plane at the same time onto the detector. For time-of-fight mass spectrometers with an ion selector, the ion selector is a particularly favorable location for this intermediate plane with time focus. For time-of-flight mass spectrometers with a collision cell for the collision fragmentation of the ions, the collision cell is a particularly favorable location.

PRIOR ART

The usual method of time-of-flight mass spectrometry with ionization of sample molecules (analytes) by laser-induced desorption from a sample support consists of subjecting the sample support to a constantly applied voltage of 5 to 30 kilovolts while facing a ground potential base electrode at a distance of about 10 to 20 millimeters. The ions, generated by a 1 to 20 nanosecond long laser light pulse, focused at the analyte layer on the sample support, leave the surface with a large spread of velocities. Particularly for the ionization method using matrix-assisted laser desorption, the spread of velocities can no longer be well focused, not even by a good reflector, which results in limitation of the mass resolution.

For the ionization of large sample molecules using matrix-assisted laser desorption (MALDI), the large sample molecules are deposited on a sample support in a layer of minute crystals of low molecular matrix substance. A light pulse from a laser lasting only a few nanoseconds, which is focused onto the sample surface, vaporizes a small amount of matrix substance and causes a quasi-explosive process, whereby the sample molecules are embraced by the expanding vapor cloud.

The vapor cloud expanding into the vacuum not only accelerates the molecules and ions of the matrix substance through its adiabatic expansion, but also the molecules and ions from the sample substance through viscous entrainment, which thereby receive higher kinetic energies than they would in conjunction with a thermal equilibrium. Even without an acceleration field, the ions attain average velocities of about 700 meters per second; the velocities are largely independent of the mass of the ions, but have a large velocity spread which extends from about 200 to 2,000 meters per second. It can be assumed that the neutral molecules in the cloud also possess these velocities.

During formation of the vapor cloud, a small portion of the molecules are ionized, and this includes the matrix molecules as well as the sample molecules. But during expansion of the vapor cloud, continuous ionization of the large molecules takes place due to further ion-molecule reactions, at the expense of the smaller matrix ions.

The large velocity distribution and the time distribution of ion formation limit the mass resolution in linear as well as in energy-focusing, so-called reflectron type time-of-flight mass spectrometers. The resolution R of linear time-of-flight spectrometers is limited to values of about 600, even during application of high acceleration voltages which allow the spread of initial velocities to be reduced relative to the average velocity ultimately attained.

But resolution is also limited in time-of-flight mass spectrometers with energy-focusing reflectors, because not all ions are formed at the same time and at the same potential in this process of continuing ionization. A spread of initial velocities alone could be focused out with the energy-focusing reflector. But ions are formed later in the expanding cloud through ion-molecule reactions, and these ions experience an initial potential which does not correspond to the surface of the sample support. This mixture of distributions of start velocities, start locations and start times for the ions can only be compensated for very incompletely, even with the best reflectors. The resolution of reflectron type mass sectrometrers, operated with MALDI, is limited to about R≈2000. To a lesser degree, this also applies to other types of ionization by desorption with laser light pulses.

The fundamental principle for an increase in the mass resolving power under conditions of pure velocity spread of the ions has been known for more than 40 years already. The method has been published in the article W. C. Wiley and I. H. McLaren, "Time-of-Flight Mass Spectrometer with Improved Resolution", Rev. Scient. Instr. 26, 1150, 1955.

It concerns a method called "time lag focusing" by the authors. More recently it has been examined under various names (for example "delayed extraction" or "pulsed ion extraction") in scientific articles relating to MALDI ionization. Recent publications such as R. S. Brown and J. J. Lennon, "Mass Resolution Improvement by Incorporation of Pulsed Ion Extraction in a Matrix-Assisted Laser Desorption/Ionization Linear Time-of-Flight Mass Spectrometer", Anal. Chem., 67, 1998, (1995)

or

R. M. Whittal and L. Li, "High-Resolution Matrix-Assisted Laser Desorption/Ionization in a Linear Time-of-Flight Mass Spectometers", Anal. Chem., 67, 1950, (1995)

may be regarded as the state of the art in current technology for application with linear time-of-flight mass spectometers. Up to now, no articles in the literature have appeared with technical solutions on time-of-flight mass spectrometers with energy-focusing ion reflectors.

The fundamental principle of this method is simple: the ions of the cloud are allowed to fly at first for a brief time in a drift region without any electrical acceleration. The faster ions thereby separate themselves farther from the sample support electrode than the slow ones, and from the velocity distribution of the ions, a location distribution results. Only then is the acceleration of the ions suddenly initiated through a homogeneous acceleration field, i.e. with a linearly declining acceleration potential. The faster ions then have a larger distance from the sample support electrode, consequently, at the onset of the acceleration, they find themselves at a somewhat reduced acceleration potential, which results in a somewhat lower ultimate velocity for the drift section in the time-of-flight spectrometer than the ions which were initially slower. With correct selection of the time lag for the start of acceleration the initially slower, but after acceleration faster ions catch up to the initially faster, but after acceleration slower ions, directly at the detector. Ions of equal mass are consequently focused, in first order, at the location of the detector with respect to their flight time. In this way a high mass resolution is attained in a linear time-of-flight mass spectrometer.

As a result, it is no longer important whether the ions have already formed during the laser light pulse, or after this time in the expanding cloud through ion-molecule reactions, as long as this formation takes place within the time before the acceleration potential is switched on. Since the velocity of the molecules is virtually unchanged by the ion-molecule reactions, those ions which were initially released as fast neutral molecules are also focused by this method.

This time-focusing plane for ions of equal mass, which is normally adjusted at the location of the detector, can wilfully be adjusted to any location in the time-of-flight spectrometer by a different selection of time lag and potential drop.

For reasons of good temporal resolution, time-of-flight spectrometers are often operated at very high acceleration voltages of up to 30 kilovolts. The switching of such high voltages for extremely short times of only a few nanoseconds is still almost unattainable even today and is associated with high costs. The authors of the 1955 article have already shown however that the total acceleration voltage need not be switched. Switching of a partial voltage suffices but requires an intermediate electrode to be installed in the acceleration path. Only the area between the sample support electrode and intermediate electrode need initially be field-free and then switched over into an acceleration field after the delay. The authors of the two cited most recent publications also use intermediate electrodes.

To switch on the acceleration field, so far it has always been the potential of the sample support electrode which has been switched, and this was also the case with the authors of the two recent articles. As will be realised, the switching range is dependent on the distance between the intermediate electrode, and the sample support because for the same acceleration field the voltage difference to be switched is the smaller, the smaller the electrode distance.

The term "high" potential, or "high voltage" always refers, in this context, to a potential which repels the ions and therefore accelerates them towards the drift tube. It can be a positive potential if the ions are positive and the drift tube is on ground potential, or it may be a negative potential if the ions are negative.

Because quick switching of the voltage is technically all the easier to manage and all the more cost-effective, the smaller the switchable voltage, it is advantageous to position the intermediate electrode as closely as possible in front of the sample support electrode. Nevertheless there is also a lower limit for this distance, since the fastest ions must always remain in the drift region during the delay.

Since the fastest ions however only move at velocities of about 2,000 meters per second, and the delay according to the literature may only amount to about 1 microsecond at a maximum, the maximum flight path of the fastest ions during the field-free time lag is only about 2 millimeters. In practice, the distance of about 2 to 4 millimeters is selected between the intermediate electrode and the sample support electrode.

This intermediate electrode however then impairs access for the focused laser light beam. Since it is also desirable to be able to observe the sample during analysis via a microscope aided by a television camera, access for a light beam for illumination and a clear view of the sample are also impaired. On the other hand, the acceleration field must be very homogeneous to create an non-divergent ion beam for the flight through the flight tube.

As prior art for this method, use of a large area, very transparent, meshed metal grid had therefore been introduced as an intermediate electrode, at a distance of about 3 millimeters from the sample support electrode. The meshed grid generates a very homogeneous acceleration field in front of the sample support electrode. The large area meshed grid allows the laser light pulse to also pass through this grid. Microscopic observation is also performed through this meshed grid. Both of the most recent cited articles use this type of meshed grids (see e.g. FIG. 1 in Brown and Lennon's article), for both the intermediate and the base electrodes.

This arrangement nevertheless has disadvantages. The laser light pulse liberates electrons from the meshed grid, the acceleration of which leads to interfering ions via impact with the residual gas. Observation suffers from considerable impairment of contrast, which is not very high anyway during this type of sample observation, due to a "curtain effect". The meshed grid can indeed be manufactured with good transparency, but even then however retains a portion of the ions. With more than one grid, the losses increase exponentially with the number of grids. Even with highly transparent grids of 80% transparency, only ⅔ of the ions still remain with two grids. At the grid of the intermediate electrode secondary ions are liberated which are accelerated in the field between the intermediate electrode and the base electrode, causing background noise. Another result of the inhomogeneous fields inside the grid meshes is the small-angle scattering of the ions leading to diffuse expansion of the beam which can no longer be corrected by lenses.

In a concurrent patent application ref. number BFA 32/95, a gridless optical device is suggested for this method, which uses open apertures for the intermediate electrode and base electrode, and corrects the divergence of the ion beam generated by this using a single lens within the drift region past the base electrode. Laser light and illumination can penetrate through further apertures adjacent to the ion beam aperture, and observation is also possible through another such aperture. At this point the descriptive text of the cited patent application should be included here in full.

The purpose of striving for good mass resolution is not only to achieve good mass determination or attain statements regarding the presence of heteroatom characteristic of an isotope by way of the visibly resolved isotopic pattern. A good mass resolution always provides an improved signal-to-noise ratio at the same time. In this way the analytic method becomes more sensitive and smaller substance amounts can be analyzed.

OBJECTIVE OF THE INVENTION

A method and a device for implementation of the known method for improving the resolution of time-of-flight spectrometers by delayed acceleration of the ions created by laser desorption ion sources is to be found, which can also be used on time-of-flight mass spectrometers with energy-focusing reflectors, and which particularly allows the high resolution measurement of daughter ions decomposed due to metastability or ones randomly fragmented by collision gases.

DESCRIPTION OF THE INVENTION

In a time-of-flight mass spectrometer with reflector, it makes absolutely no sense to make the time focusing plane coincide with the detector plane by appropriately adjusting the delayed acceleration, as is common use in linear time-of-flight mass spectrometers. The reflector temporally disperses ions of the same mass but different velocity, and thus destroys the velocity focusing caused by the delayed acceleration method.

As was however already mentioned above, the plane of exact time-focusing for ions of equal mass can be adjusted as desired to any location along the flight path by the choice of time lag and acceleration field strength in front of the sample support electrode.

It is therefore the basic idea of the invention to adjust this time-focusing plane to an arbitrary but fixed location between the ion source and the reflector by using delayed acceleration, and to set the reflector so that it consequently focuses the ions of equal mass which, in spite of differing velocities, pass this focusing plane at the same time, onto the detector. The reflector therefore views the focus plane as an intermediate (virtual) ion source which supplies ions of equal mass with the same start point (at exactly this plane) and the same start time but different start energies, and it can reflect these ions in such an excellent manner (to second order) that they again arrive on the detector at the same time in spite of differing start velocities. The conditions for creation of this intermediate (virtual) ion source can be easily set by the choice of delay (time lag) and potential drop (voltage difference) of the delayed acceleration.

It is not disadvantageous that the ions of different masses already display a temporal mass dispersion when passing this focus plane. This mass dispersion becomes even larger due to the differing flight times for ions of differing masses up to the detector and generates the desired mass dispersion of the reflectron time-of-flight mass spectrometer.

For this changed method of delayed acceleration for time-of-flight mass spectrometers with energy-focusing reflectors, the gridless ion source optical device can also be used to advantage, as is described in the concurrent patent application BFA 32/95 (U.S. patent application filed Apr. 4, 1996, having named inventors Armin Holle, Claus Koster and Jochen Franzen, and being identifiable by Bookstein & Kudirka, P.C. Attorney Docket No. B0004/7020.)

This improvement of resolution for reflecting time-of-flight spectrometers is not however in itself of particular value, since the same results can be achieved by a longer linear time-of-flight spectrometer, which also has a greater mass dispersion due to its greater length, much more easily and without the complicated reflector. Only the additional spatial focusing of some types of reflectors may be additionally advantageous.

However, it is a further basic idea of the invention to also use the same principle of focusing on ions decomposing due to metastability or on ions randomly fragmented in collision chambers.

In time-of-flight mass spectrometers, ions are accelerated to have the same kinetic energy. The ion's mass is then measured by its velocity (via measured flight time and known flight length), which is, at constant energy, dependent on the mass only. In reflectron type spectrometers, a slight spread of initial kinetic energies can be fosused out by the energy-focusing reflector.

During the generation of daughter ions by decay of parent ions, the velocity is kept, and mass and energy are reduced in the same proportion. The initial energy spread becomes a velocity spread. For daughter ions of a certain mass, the velocity spread again can be focused out by the energy-focusing (now: velocity-focusing) reflector.

If a metastable ion decomposes en route between the ion source and reflector, its mass indeed changes but its velocity and direction undergoes virtually no change. If the reflector is now set so that it can reflect daughter ions of reduced mass with the same velocity, it enables a mass analysis of daughter ions. The electric field inside the reflector performs primarily an energy analysis, but because energy and mass of the newly formed daughter ions are proportionally reduced, a mass spectrum is taken with focusing of their differences in velocity. In this way a high mass resolution is attained during the detection of fragmentation products from metastable ions. The spectra of daughter ions from decomposing metastable parent ions can thereby be measured at high resolution.

This principle of mass analysis for ion fragments of ions decomposing due to metastability has become known by the name "post source decay" (PSD). The method has now become wide-spread, although it only provides a low mass-resolving power. The improvement of mass resolving power described here can in particular provide the normally very noisy method with an improved signal-to-noise ratio. But also the mass determination of the fragment ions, which is especially important for amino acid sequence analysis of peptides and proteins, can be greatly improved.

With complicated primary spectra showing many different ion types, the fragmented ions which have decomposed due to metastability can no longer be assigned to a certain parent ion type. Here, an ion selector helps which selects ions of equal velocity during their flight through the drift section. The ion selector is a fast switching element for the ion beam which deflects the unwanted ions and allows the selected ions to pass through. These ions consist of the parent ions and their metastable daughters which both have the same speed. There are different embodiments for this switching element, which is essentially a short pair of electrodes between which the ions must pass, and to which a laterally deflecting electric field can be applied very quickly. The ion selector must be located at a position where good separation of the ions of different masses through mass dispersion prevails, usually selecting for this a position somewhat midway between ion source and reflector. The mass resolving power (R) attained by velocity selection is moderate, amounting to only about 50 to 200 for very good ion selectors. The mass resolving power is limited by the fact that ions of the same mass do not pass the selector all at the same time due to the spread of velocities. In order to increase mass resolution, the intermediate time-focusing plane can be situated directly in the ion selector by delayed acceleration.

As already noted, the ion selector chooses ions not actually according to mass, but rather to flight velocity. Since a daughter ion which has decomposed due to metastability has the same velocity as the parent ion from which it came, the ion selector also allows all fragmented ions of the selected ionic type to pass through as desired. In this way all the fragmented ions which decompose between the ion source and the reflector can be measured by an energy analysis by the reflector, resulting in a mass spectrum of the daughter ions.

There are however particular advantages in measuring not only the independently decomposing, so-called metastable ions, but also the ions randomly fragmented in a collision cell through collisions with collision gas. During these collisions, particularly when using very effective heavy collision gases, notable changes in the velocity of the resulting fragmented ions can arise due to the principle of pulse reservation. If one however now locates the intermediate time-focusing plane by delayed acceleration exactly in the collision chamber, the initial and additional collision-induced spread of velocities can again be focused out in this way by the reflector. Fragmented ions which come from parent ions of the same mass and therefore leave the collision chamber at the same time, can be detected with high resolution, even if they suffer notable velocity changes due to heavy collision gases.

When simultaneously using the ion selector and collision chamber, they should both be located as closely as possible to one another. Whether to locate the focusing plane by delayed acceleration in the ion selector or in the collision chamber is dependent upon problem definition of the analysis.

1=sample support as the first electrode in the acceleration path,

2=intermediate electrode for the switchable acceleration field,

3=base electrode at ground potential,

4=tilted mirror for the laser light pulse,

5=single lens consisting of three electrodes for focusing the ion beam,

6=concave mirror for deflecting and focusing the laser light pulse,

7=laser for generation of the light pulse for desorption and ionization,

8=ion beam between the ion source and ion reflector,

9=plane for the time-focusing of ions of equal mass,

10=ion reflector for energy-focusing deflection of the ion beam,

11=ion beam between the reflector and detector,

12=ion detector.

Figure 2:
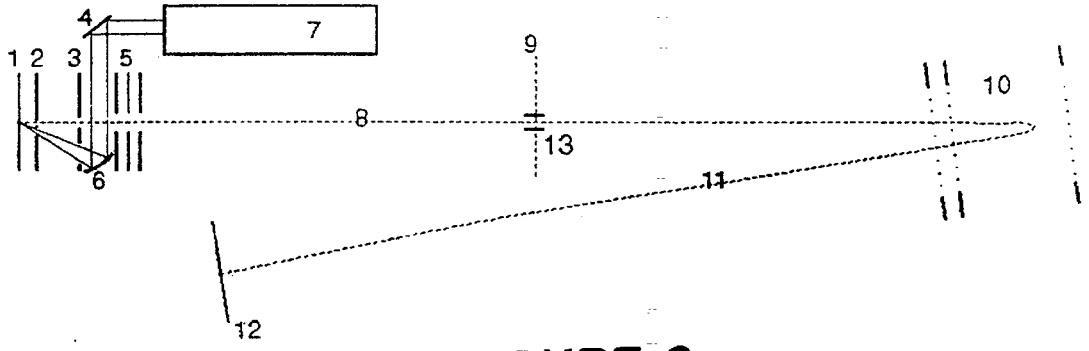

FIG. 2 shows a similar mass spectrometer that has however an Ion Selector 13 arranged at position 9, with which ions of a certain velocity are allowed through but other ions can be sorted out by trajectory deflection.

Figure 3:
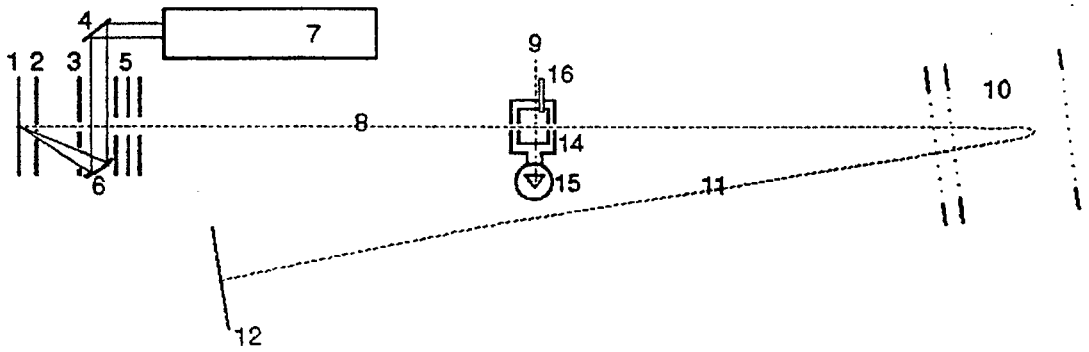

FIG. 3 shows a similar mass spectrometer which possesses a Collision Chamber 14 at position 9 for fragmentation of ions which fly through. The collision chamber is differentially pumped by Pump 15 and supplied with collision gas via Gas Line 16.

Figure 4:
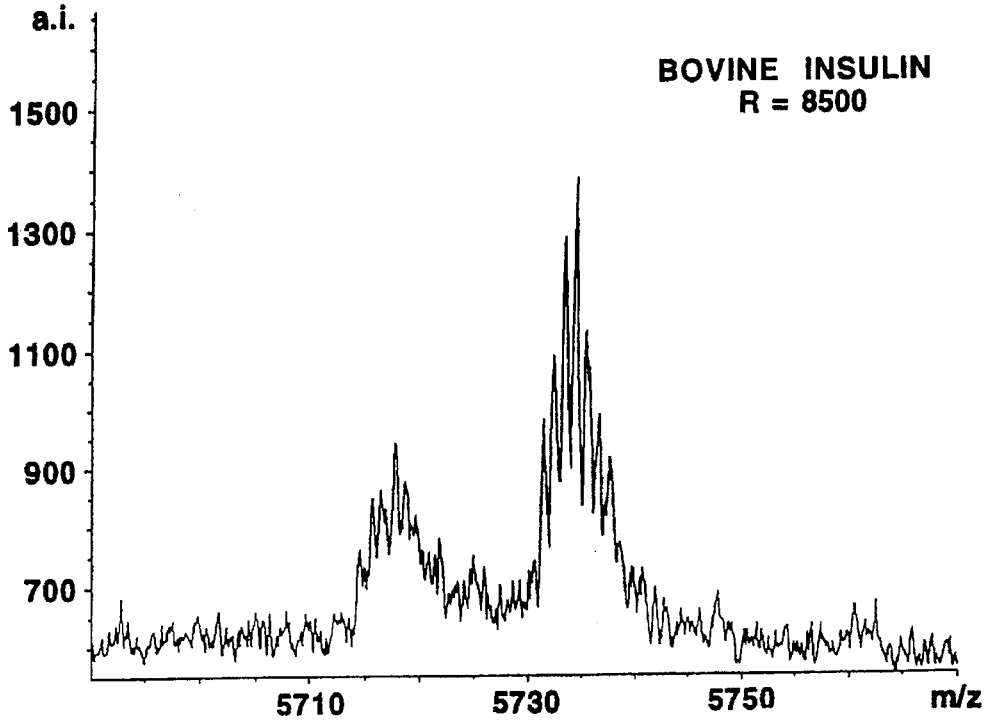
Figure 5:
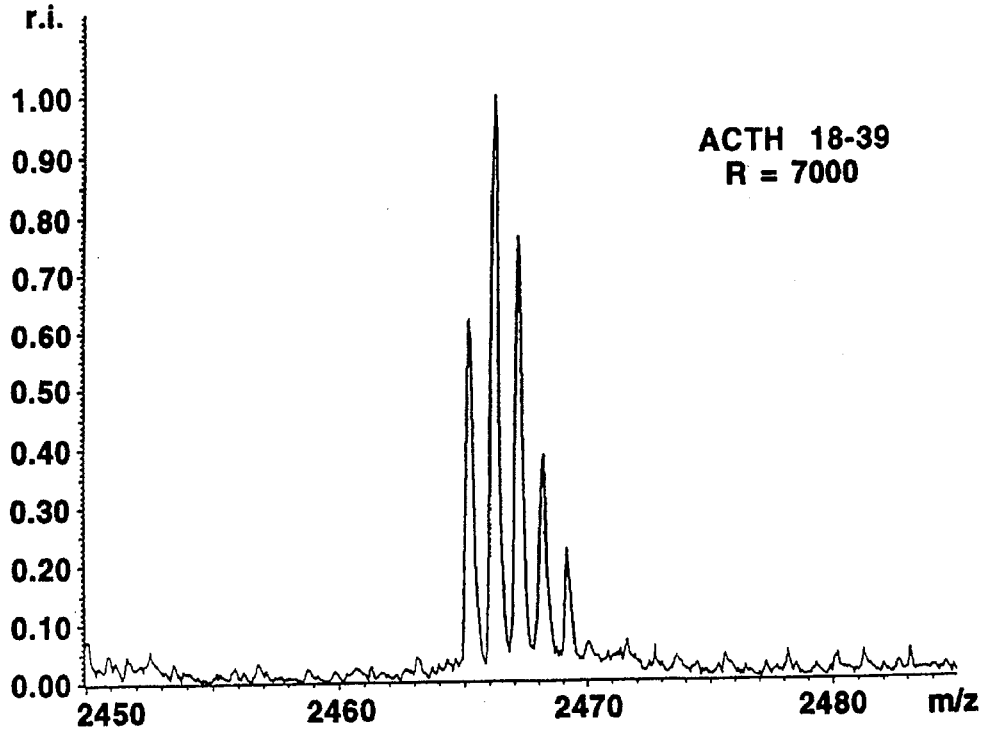

FIGS. 4 and 5 show the highly resolved primary spectra of two different substances that were measured according to this invention.

Figure 6:
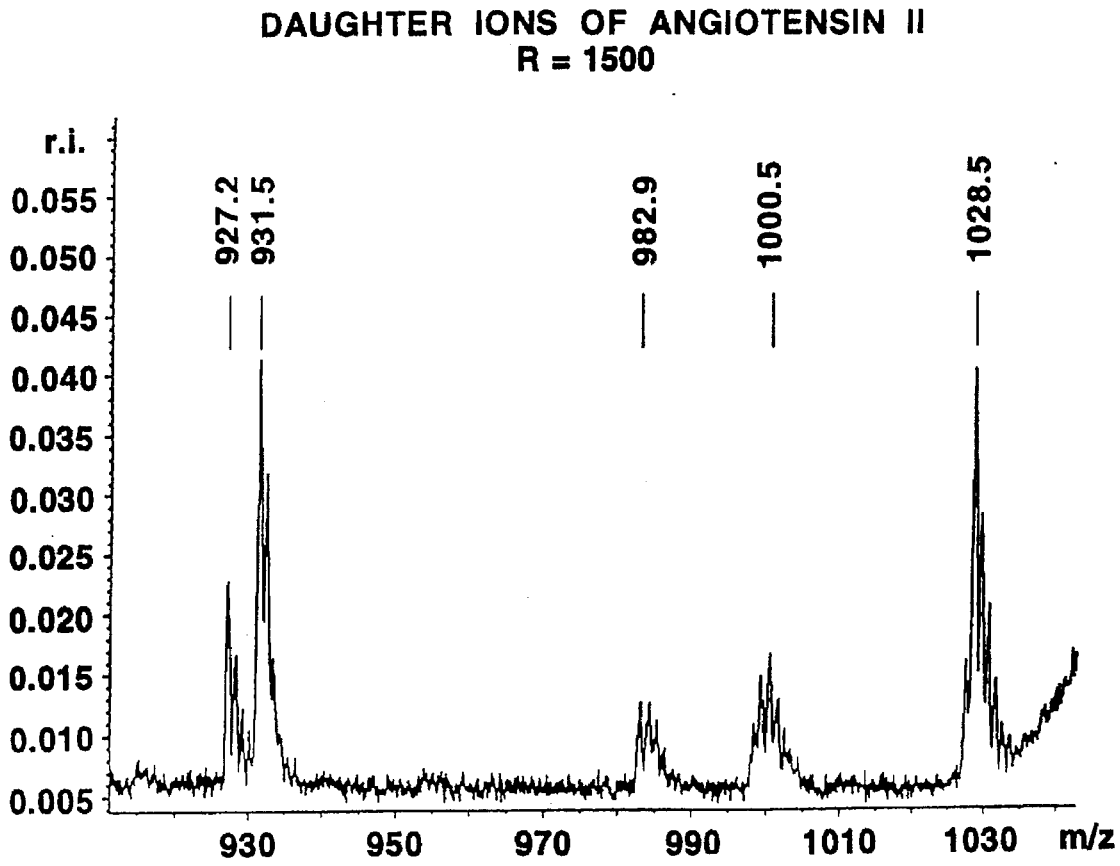

FIG. 6 shows part of a highly resolved fragmentation spectrum, the ions of which were generated by metastable decay.

PARTICULARLY FAVORABLE EMBODIMENTS

Figure 1:
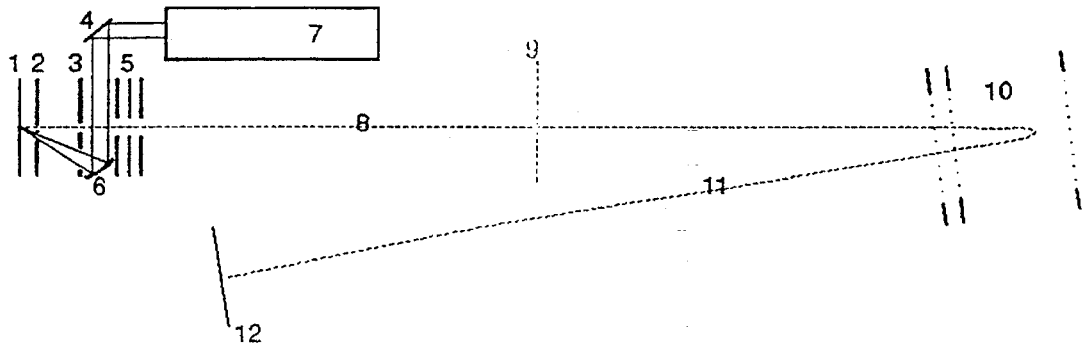
FIG. 1 shows a schematic of a time-of-flight mass spectrometer that can be used for this method. According to the invention the intermediate plane for time-focusing can be found at position 9 between the ion source and ion reflector, and ions from position 9 are illustrated as velocity-focused from reflector 10 onto detector 12. It is comprised of the following parts.

A particularly favorable embodiment is shown schematically in FIG. 1. The sample substance, together with the matrix substance, is applied in the form of a thin crystal layer onto the surface of metal Sample Support Electrode 1. The sample support electrode can be brought through a vacuum lock (not shown) into the vacuum of the mass spectrometer and contact is automatically made with a high voltage feeder (not shown). The sample support electrode can be moved in x-y direction using a moving device (not shown) parallel to its sample surface. In this way several sample assignments can be applied next to one another and analyzed one after another.

The ion source consists of Sample Support Electrode 1, the Intermediate Electrode 2, the potential of which is switchable for this method, of Base Electrode 3, which is at the same potential as the flight tube, and of Single Lens 5. The flight tube (not shown) consists of Flight Path 8 of the time-of-flight spectrometer in front of Reflector 10, Flight Path 11 after the ion Reflector 10, and Ion Detector 12. It is normally at ground potential. Einzel Lens 5, consisting of front electrode, terminating electrode, and center electrode, is attached at the start of the flight path directly behind Base Electrode 3. The front electrode and terminating electrode are both at the same potential as the flight tube, the center electrode at the same potential as the lens.

At the beginning of the procedure, Sample Support Electrode 1 and Intermediate Electrode 2 are both at the high acceleration potential of about 30 kilovolts. Base Electrode 3 is at ground potential. The center electrode of the lens is at a previously optimized lens potential of about 10 to 15 kilovolts.

The sample is then irradiated by a brief laser pulse of about 3 nanoseconds length from Laser 7. The laser light pulse is deflected by Tilted Mirror 4 onto Concave Mirror 6, and Concave Mirror 6 focuses the light pulse onto the sample surface on Sample Support Electrode 1. Cost-efficient nitrogen lasers have proven to be particularly suitable, delivering light at a wavelength of 337 nanometers. Relatively weak light pulses with a total energy of about 50 microjoules with a focus diameters of roughly 150 mikrometers show good results.

As has already been described above, a small amount of matrix and sample substance vaporizes, forming a cloud which explosively expands adiabatically into the surrounding vacuum. Some ions from the sample analyte substance form during the vaporization process, others form later in the cloud due to ion-molecule reactions with the ions from the matrix. Acceleration of all the molecules in the field-free region is essentially generated by the adiabatic expansion of the cloud which mainly consists of molecules from the matrix substance. The heavier molecules and ions from the sample substance are accelerated within the exploding cloud due to viscous entrainment, and therefore all the molecules and ions have about the same velocity distribution, ranging from about 200 to 2,000 meters per second, and reaching a maximum at about 700 meters per seconds. The cloud plasma is first neutral, since positive as well as negative ions, as well as some electrons, are present. Since the electrons quickly escape from the plasma, a slightly ambipolar acceleration of fringe ions takes place in the fringe areas which the escaping electrons generate between themselves and the remaining plasma. This effect is however minimal.

The process of the adiabatic expansion of the cloud lasts only about 30 to 100 nanoseconds, depending on the density of the cloud. After this time, all contact between the molecules is lost due to the thinning of the cloud, and further acceleration no longer takes place. The velocity distribution is thereby frozen and there are no more ion-molecule reactions.

After a selectable time lag, the potential of the intermediate electrode is switched down to a new, selectable potential. We use a potential supply which can be switched with a delay of 100 to 300 nanoseconds at a potential range of up to 8 kilovolts with a switching speed of 8 nanoseconds for the potential. Favorable values for raising the resolution are about 140 nanoseconds for time lag and 8 kilovolts for switching range.

Until the acceleration is switched on, the fastest ions have flown further away from the sample support than the slow ones. They are therefore at a lower potential when acceleration is switched on, and no longer receive full acceleration from the high voltage. This effect leads, as already stated above, to a temporal focusing of ions of equal mass in one focus plane, the position of which can be adjusted by choice of time lag and acceleration field. For a time-of-flight mass spectrometer without reflector operation, the position of this focus plane is adjusted exactly to the ion detector; in this way, all ions of equal mass arrive there through the cloud at the same time, in spite of different initial velocities, and mass resolution is increased.

If the reflector is used, the position of the focus plane must then, according to the invention, be adjusted to a location between the ion source and ion reflector, therefore for example at Position 9 on FIG. 1. This location then forms, for Reflector 10, a kind of virtual ion source, which releases ions of the same mass at exactly the same time although the ions do have a velocity spread. Reflector 10 must therefore now be adjusted in such a way using a certain ratio of deacceleration field and reflection field, that it velocity-focuses the ions from this virtual ion source with time-focus onto Detector 12.

If certain types of ions decompose during the flight path between ion source and ion reflector into daughter ions and neutral fragments, the daughter ions have the same gross velocity (and same velocity spread) as the parent ions from which they came. The daughter ions however have a lower mass and therefore at the same velocity a lower kinetic energy. Since the ion reflector can be used as an energy analyzer, it can be implemented for measurement of energies and therefore of masses of the daughter ions. This principle of mass analysis for ion fragments of ions decomposing due to metastability is widely known by the name "post source decay" (PSD). The method has now become widespread.

The principle of the virtual ion source with time-focused ions of one mass also applies to the daughter ions. These too have strict time-focusing in the focus plane. Even such ions which decompose after flying through this focus plane have virtual focusing in this plane, i.e. they appear to have flown away from the focus plane at the same time. The previously small mass resolving power of the PSD method is therefore greatly increased by this invention, as a result of which mass determination of the fragmented ions, which is particularly important for the amino acid sequence analysis of peptides and proteins, is greatly improved. In addition, the method has suffered up to now from very strong background noise in the spectra. The improvement in the mass resolving power mentioned here now provides the method with a highly improved signal-to-noise ratio. Both improvements—mass resolution and signal-to-noise ratio—open up new application areas for this method.

With complicated primary spectra showing many different ion types the fragmented ions which have decomposed due to metastability can no longer be assigned to a certain parent ion type. Here, an ion selector helps which selects ions of equal velocity during their flight through the drift section. FIG. 2 shows a mass spectrometer with such an Ion Selector 13. Ion Selector 13 is a fast switching element for the ion beam which deflects the unwanted ions and allows the selected ions to pass through. It has usually the form of a short electrode plate pair between which the ions must pass and to which a laterally deflecting electric field can be applied very quickly. The masses of the ions must be separated here as well as possible, so that the ion selector already sees a good separation of ions of different masses. Usually the center position between the ion source and reflector is selected here. The focusing-plane generated by the delayed acceleration is best located exactly in the ion selector as is shown in FIG. 2.

As already noted, the ion selector selects ions not actually according to their mass, but rather according to their flight velocity. Since a daughter ion which has decomposed due to metastability has the same velocity as the parent ion from which it came, the ion selector allows all fragment ions of the selected ion types to pass through as desired. Therefore all fragmented ions, which are formed between the ion source and reflector through decomposition of parent ions, are measured by energy analysis of the reflector as a mass spectrum, irrespective of whether the decay takes place in front of or behind the selector.

There are particular advantages, however, if one not only measures the independently decomposing ions, but also the ions decomposinng in Collision Cell 14, as shown in FIG. 3, randomly fragmented through collisions with the molecules of a collision gas. Collision Cell 14 is differentially pumped by Pump 15, the collision gas supplied by Feeder 16. During collisions of ions flying through with the molecules of the collision gas, notable changes in the velocity of the resulting fragmented ions can arise due to the principle of pulse reservation, particularly if heavy collision gas molecules are used. If however Time-Focusing Plane 9 is now situated by delayed acceleration exactly in Collision Chamber 14, the initial and additional collision-induced spread of velocities can be focused out again by the reflector. Fragmented ions which come from parent ions of equal mass, which therefore leave the collision chamber at the same time, can be detected with high resolution even if they suffer notable velocity changes due to heavy collision gases. Collision chambers are used to particular advantage in conjunction with ion selectors. Collision chambers need not be continuously filled with collision gas. It is sufficient if the collision chamber is filled with short gas bursts.

The example given here of a time-of-flight mass spectrometer and of a method for this invention can naturally be varied in many ways. The specialist in the development of mass spectrometers, especially in the development of desorption ion sources, can easily implement these variations.

For example, the collision chamber can be replaced by a simple gas nozzle which faces a high vacuum pump. This simple arrangement is equivalent to that of a complex collision chamber, but costs only a fraction. The nozzle can have gas fed through it continuously, but it is even better to operate it in pulses using a switching valve. The ion reflector, which is illustrated in the schematics of FIGS. 1 to 3 as a grid reflector, can be replaced favorably by a gridless reflector which even may have additional spatial focusing properties. The ion selector can be designed as a fanned switching element These changes are not to be described further here, since they are known to the specialist from publications and patents.

FIGS. 4 to 6 show measurements of mass spectra using MALDI methods, which were scanned with an increase of mass resolution through delayed acceleration of the ions after a laser light pulse. In FIGS. 4 and 5, primary spectra are shown which normally only depict undecomposed ions. With bovine insulin (FIG. 4), the fragmented ions, which resulted from a splitting off of water, are however already visible at the same time as the molecule ions. In FIG. 6, a partial spectrum of fragmented ions from angiotensin is shown. This spectrum shows a resolution of isotopic lines which would not be visible without an improvement of the resolution by delayed application of acceleration and the special position of the focus plane according to this invention.

We claim:

1. Method for the high resolution analysis of analyte ions in a time-of-flight mass spectrometer with an energy-focusing ion reflector, comprising the steps of (a) ionizing analyte molecules on a support electrode by pulsed laser desorption, (b) delaying the acceleration of the ions with respect to the laser pulse, so that all ions which leave an ion source with the same ratio of mass to charge experience time-focusing at a spatially fixed time-focus plane in spite of their different velocities, (c) adjusting this time-focus plane, by selection of time lag and acceleration field strength of the delayed acceleration, at a fixed location between the ion source and the reflector, and (d) focusing ions of equal mass, which simultaneously leave this time-focus plane, onto the detector by adjustment of the reflector potentials, so that they arrive at the same time, in spite of their different velocities.

2. Method as in claim 1, wherein the analyte molecules are ionized by the known method of matrix-assisted laser desorption and ionization (MALDI).

3. Method as in claim 1, further comprising an ion selector between said ion source and said reflector, wherein the time-focus plane for ions of the same mass is placed at the location of the ion selector in order to obtain good mass resolution with the ion selector.

4. Method as in claim 1, wherein such ions that decompose due to metastability on the path between the ion source and the reflector, are subjected to mass analysis by the reflector.

5. Method as in claim 1, further comprising a collision cell between said ion source and said reflector, wherein the time-focus plane for ions of the same mass is placed in this collision cell so that the velocities of the ions of equal mass, changed by the collision, are focused by using the reflector, and wherein a mass analysis of fragmented ions is undertaken by using the reflector.

6. Method as in claim 1, wherein the delayed acceleration is switched on by a switchable electric field between the sample support and an intermediate electrode, whereby the intermediate electrode is located between the sample support and a grounded base electrode, wherein both the intermediate electrode and the base electrode have gridless openings for the passage of ions, and wherein an ion beam divergence is formed by a lens arrangement located past the base electrode.

7. Time-of-flight mass spectrometer for implementation of the method according to claim 1, contained in a vacuum housing, at least consisting of (a) a conductive sample support electrode, (b) an intermediate electrode for the generation of the acceleration field between the sample support and the intermediate electrode, having a gridless aperture for passage of an ion beam, (c) a base electrode at the potential of a flight tube, having a gridless aperture for passage of the ion beam, (d) a lens arrangement at the beginning of the flight tube, and (e) the flight tube with the ion reflector and the ion detector, wherein the intermediate electrode and the base electrode have gridless apertures for the ion beam.

8. Time-of-flight mass spectrometer as in claim 7, wherein the ion reflector has gridless apertures.

9. Time-of-flight mass spectrometer as in claim 7, further comprising an ion selector located between an Einzel lens and the ion reflector, and wherein the time-focus plane for ions of the same mass essentially coincides with the location of the ion selector.

10. Time-of-flight mass spectrometer as in claim 7, further comprising a spot of high density collision gas for the fragmentation of ions situated in the ion path between the ion source and the ion reflector, and wherein the focus plane largely coincides with this spot.

11. Time-of-flight mass spectrometer as in claim 10, wherein the spot of high density collision gas is represented by a differentially pumped collision chamber.

12. Time-of-flight mass spectrometer as in claim 10, wherein the spot of high density collision gas is established by a nozzle perpendicular to the flight path from which the collision gas flows.

13. Time-of-flight mass spectrometer as in claim 10, wherein the collision gas is fed to the high density spot via a fast switching gas valve in pulses.

14. Method for the high resolution analysis of sample ions in a time-of-flight mass spectrometer with an energy-focusing ion reflector, with ionization of sample molecules by laser desorption, and with delayed acceleration of the ions so that all ions which leave the ion source with the same ratio of mass to charge, experience time-focusing at a spatially fixed time-focus plane in spite of their different velocities, comprising the steps of (a) adjusting this time-focus plane, by selection of time lag and voltage drop of the delayed acceleration method, at a fixed location between the ion source and the reflector, and (b) focusing ions of equal mass, which simultaneously leave this time-focus plane, onto the detector by adjustment of the reflector potentials, so that they arrive at the same time, in spite of their different velocities.

* * * * *

Adverse Decision In Interference

Patent No. 5,654,545, Armin Holle, Claus Koster, Jochen Franzen, IMPROVED MASS RESOLUTION IN TIME-OF-FLIGHT MASS SPECTROMETERS WITH REFLECTORS, Interference No. 104,615, final judgment adverse to the patentees rendered June 12, 2001, as to claims 1-4, 6-9 and 14.

*(Official Gazette July 10, 2001)*